US008506136B1

(12) United States Patent
Herdt

(10) Patent No.: US 8,506,136 B1
(45) Date of Patent: Aug. 13, 2013

(54) EXTERIOR LIGHT STRING WITH DEPLOYMENT TRACK AND STORAGE MEANS

(76) Inventor: Keith Herdt, Velva, ND (US)

( * ) Notice: Subject to any disclaimer, the term of this patent is extended or adjusted under 35 U.S.C. 154(b) by 798 days.

(21) Appl. No.: 12/632,488

(22) Filed: Dec. 7, 2009

Related U.S. Application Data

(60) Provisional application No. 61/200,907, filed on Dec. 5, 2008.

(51) Int. Cl.
*F21V 21/34* (2006.01)

(52) U.S. Cl.
USPC ..... 362/391; 362/249.09; 362/249.14; 362/249.16; 362/418

(58) Field of Classification Search
USPC ..... 362/249.01, 249.07, 249.09, 249.11, 362/249.14–249.19, 391, 418, 419
See application file for complete search history.

(56) References Cited

U.S. PATENT DOCUMENTS

| | | | | |
|---|---|---|---|---|
| 4,901,212 | A | 2/1990 | Prickett | |
| 6,050,703 | A | 4/2000 | Herbert | |
| 6,050,709 | A | 4/2000 | Hastings | |
| D452,581 | S | 12/2001 | Zakrzewski et al. | |
| 6,364,508 | B1 | 4/2002 | Moreland | |
| 6,485,161 | B1 | 11/2002 | Whitaker et al. | |
| 6,585,394 | B2 | 7/2003 | Diaco | |
| 6,652,121 | B1 | 11/2003 | Kneeshaw | |
| D486,602 | S | 2/2004 | Hines et al. | |
| 6,827,379 | B2 * | 12/2004 | Hill et al. | 294/211 |
| 6,843,583 | B2 | 1/2005 | Winter | |
| 7,066,618 | B1 * | 6/2006 | Little | 362/147 |
| 7,159,998 | B2 * | 1/2007 | Moreland | 362/249.01 |
| 7,517,117 | B2 * | 4/2009 | Moreland et al. | 362/391 |
| 7,878,684 | B2 * | 2/2011 | Nauman | 362/249.1 |
| 8,152,112 | B2 * | 4/2012 | Miller et al. | 248/48.1 |
| 2005/0166529 | A1 * | 8/2005 | Rodolofo et al. | 52/716.1 |
| 2010/0110668 | A1 * | 5/2010 | Marlonia | 362/152 |
| 2011/0164409 | A1 * | 7/2011 | Smith et al. | 362/145 |

* cited by examiner

*Primary Examiner* — Jong-Suk (James) Lee
*Assistant Examiner* — Leah S Macchiarolo
(74) *Attorney, Agent, or Firm* — Montgomery Patent & Design; Robert C. Montgomery

(57) ABSTRACT

An outdoor light string that is deployed along a track and stored in a box at the end of the track intended to aid in installing a light string provides for an inverted hanging track mounted along the roof line, overhang, railing, or other structure used to support the light string. A first end of the track system is provided with a removable storage box used to hold the light string in a looped fashion. When needed, the box is opened on the end facing the track, and a hook stick is used to grab a loop at the end of the light string. It is then pulled out and secured at a second end of the track. The light string is supported with intermediate trolley hangers along the track. The light string is guided back into the storage box for storage and protection.

17 Claims, 6 Drawing Sheets

EXTERIOR LIGHT STRING WITH DEPLOYMENT TRACK AND STORAGE MEANS

RELATED APPLICATIONS

The present invention was first described in and claims the benefit of U.S. Provisional Application No. 61/200,907, filed Dec. 5, 2008, the entire disclosures of which are incorporated herein by reference.

FIELD OF THE INVENTION

The present invention relates generally to decorative lighting fixtures, and in particular, to a time saving system and apparatus for track-mounted exterior lighting.

BACKGROUND OF THE INVENTION

Outdoor decorative lighting fixtures are a common and vaunted part of many holiday celebrations. In particular, such lights abound during the season leading up to Christmas. In the modern day, many different variations of such lights have become popular, including many variations such as multicolored light strings, plain white lights, "icicle"-style lighting strings, blinking lights, and the like.

One (1) major problem with such traditional decorative lighting fixtures is the time and effort associated with their installation. Common light strings are often stored indoors for the majority of the season, leading to difficult to untangle messes. Furthermore, the impermanent nature of the mounting means often means that the lights are installed insecurely and the mounting fixtures must be reinstalled every year. The high-hanging nature of many such decorative assemblies can lead to even more increased time of setup as well as increase risks. The process of tearing down the lights becomes and equally time consuming endeavor.

Various attempts have been made to provide decorative lighting systems. Examples of these attempts can be seen by reference to several U.S. patents. U.S. Pat. No. 6,485,161, issued in the name of Whitaker et al., describes an outdoor decorative lighting system. The Whitaker system provides a series of customizable tracks for the installation of permanent lighting fixtures.

U.S. Pat. No. 6,843,583, issued in the name of Winter, describes a device for storing and displaying decorative light strings. The Winter device consists of hemispherical light housings rotatably mounted within hemispherical tracks. This allows a user to open and close the lighting portions by rotating them within or without the tracks.

Additionally, ornamental designs for a decorative lighting fixture exist, particularly U.S. Patent Nos. D 452,581 and D 486,602. However, none of these designs are similar to the present invention.

While these devices fulfill their respective, particular objectives, each of these references suffer from one (1) or more of the aforementioned disadvantages. Many such apparatuses do not allow a user to easily remove lights for indoor storage. Also, many such apparatuses do not provide an unlimited range of simple user customizability with regards to length and directions of a mounting track. In addition, many such apparatuses do not allow a user to store lights in a tangle-free manner which allows for very simple and quick reinstallation of the lights in the future. Furthermore, many such apparatuses do not provide simple and stable securing mechanisms for a mounted light string which is both retrofittable and adaptable to custom light strings. Accordingly, there exists a need for a track-mounted exterior decorative lighting system and apparatus without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide for the simple, quick, and repeatable installation of exterior decorative lighting fixtures in a manner which provides consistency, customizability, and simple storage. Thus, the object of the present invention is to solve the aforementioned disadvantages and provide for this need.

To achieve the above objectives, it is an object of the present invention to comprise an inverted light track which is fastened to a mounting surface and enables a user to deploy a light string from a removably attached light box. The apparatus enables a user to quickly deploy and take down light strings in a safe manner for various festive occasions.

Another object of the present invention is to comprise a light track, a light box, a light string, and a plurality of hangers. In a preferred embodiment, the components are constructed of a lightweight, durable, weather resistant material such as aluminum, thermoplastic, or the like, fabricated via common techniques.

Yet still another object of the present invention is to comprise the light track of an elongated track body mounted to the underside of a surface such as a soffit, a gutter, or the like via a plurality of mounting fasteners. The fasteners comprise a common fastener such as nails, screws, or the like. The track is made available in sections, which a user may easily cut to a desired length and shape with standard hand tools. In a preferred embodiment, the sections are joined together by arranging their ends in a parallel manner.

Yet still another object of the present invention is for the light box to house the light string during times when the string is not being utilized. The light box is removably attachable to an end of the light track, allowing the light string to be deployed from the box and into the light track.

Yet still another object of the present invention is to comprise the light string of expected features similar to other commercially available string, icicle, or curtain lights. This includes features such as electrical wiring, a plurality of lights, a plurality of bulb receptacles, a plug, and the like. The light string further comprises a pull ring located on each end, which enables a user to deploy the string throughout the track by pulling on the ring with a hook.

Yet still another object of the present invention is to comprise a stick, which further comprises a hook and a handle. The hook is integrally molded onto an end of the stick. The handle is located at the opposite end and comprises a means for a user to grip the stick.

Yet still another object of the present invention is to comprise the light track of a plurality of fastener tabs with fastener apertures, equally spaced at opposing sides of a top surface of the track. The track is mounted to a surface via placing fasteners through the corresponding apertures located within the fastener tabs.

Yet still another object of the present invention is to further comprise the light track of a rectangular channel with a hollow inner track. The inner track provides a means to house and guide the plurality of hangers, which slide along the track in a manner similar to a shower curtain. The track further comprises a hanger slot along the bottom to allow the hanger to extend downwards in order to secure the light string.

Yet still another object of the present invention is to further comprise the light track of an end hook which is attached to a vertical end surface of the light track. The hook pivots approximately ninety degrees to a vertical orientation in order to engage a pull ring and secure the light string in place once deployed.

Yet still another object of the present invention is to comprise an opposing end of the light string of a standard electrical plug to provide power to the light string. The track further comprises a recessed groove along both upper, outer surfaces. The groove interfaces with corresponding protruding rails of the light box.

Yet still another object of the present invention is to comprise a hanger of a roller, a clip, and a stem. The roller is a generally round member which fits with the inner track of the light track and provides a full range of rotational movement within the track.

Yet still another object of the present invention is for the stem to extend out from the roller and through to the underneath surface of the light track. The clip is located on the end of the stem and comprises a tubular clamp-like segment capable of accepting and securing the light string. The total number of hangers used varies depending on the length of the light track and the length and configuration of the light string.

Yet still another object of the present invention is to comprise the light box of a main body, a pair of rails, an open front, a rear wall, and an open top. The body comprises a generally rectangular box shape with rails located on upper inner surfaces of the box.

Yet still another object of the present invention is to comprise the open top of the box of a shape which corresponds to the outer shape of the light track. The light track is insertable into the open top portion, and the rear wall provides an end-stop for the light track. The open front portion further houses the light string for deployment into the light track.

Yet still another object of the present invention is to neatly loop the light string within the open front portion of the box, in a manner similar to an open curtain. The box provides a storing means for the light string and the hangers while they are not being used. The box further comprises a front door and top door which may be closed in order to provide an enclosed storage area.

Yet still another object of the present invention is to provide a method of utilizing the device that provides a unique means of permanently, customizably installing a light track, and allowing a user to quickly, simply, and safely deploy a string of decorative lights throughout the track and subsequently remove and store the lights for later use.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
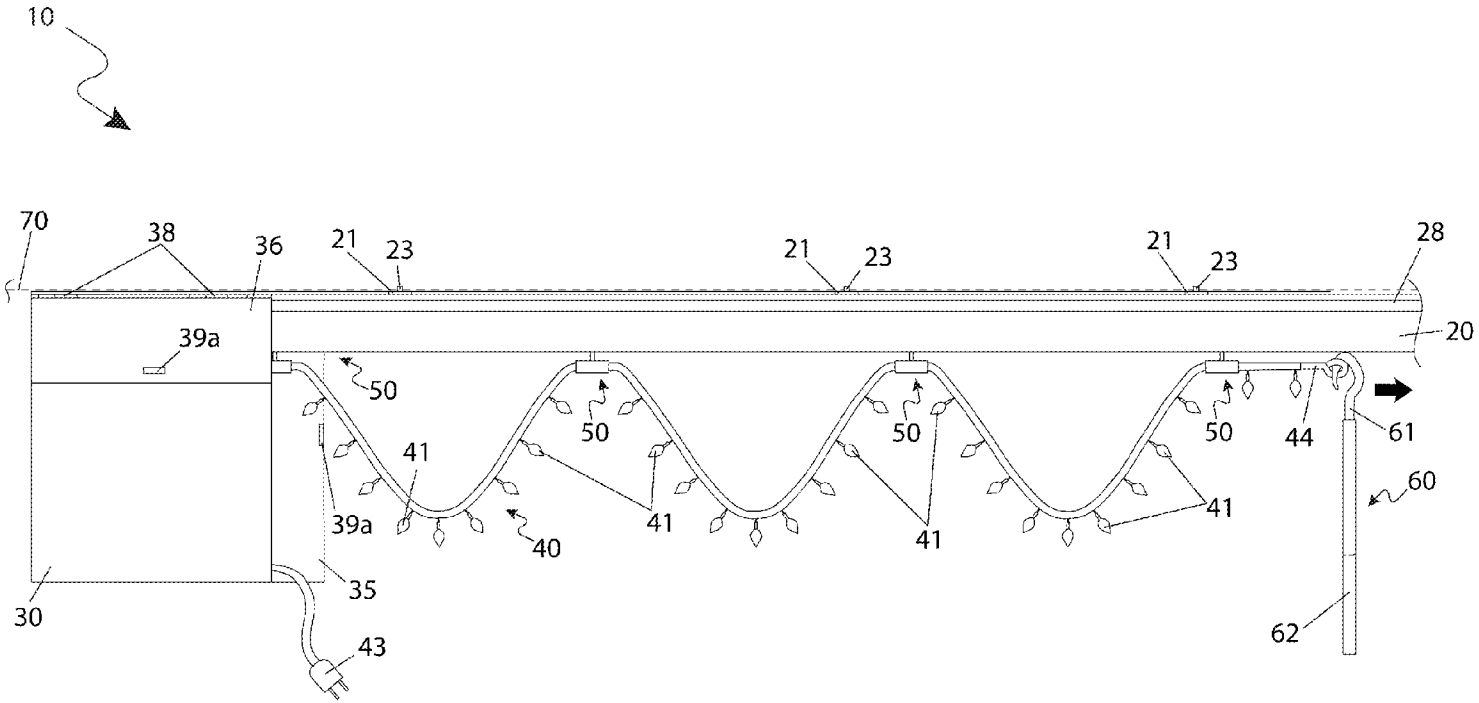
FIG. 1 is a side environmental view of a track-mounted exterior light string 10, according to a preferred embodiment of the present invention.

10 track-mounted light string
20 light track
21 fastener tab
22 fastener aperture
23 mounting fastener
24 inner track
25*a* first hanger slot
25*b* second hanger slot
26 end hook
27 hook fastener
28 groove
30 light box
31 body
32 rail
33 open front
34 open top
35 front door
36 top door
37 plug aperture
38 hinge
39*a* first fastener
39*b* second fastener
40 light string
41 light
42 bulb receptacle
43 plug
44 pull ring
45 rear wall
50 hanger
51 clip
52 roller
53 stem
54*a* second latch
54*b* second slot
60 stick
61 hook
62 handle
70 mounting surface

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a track-mounted exterior light string (herein described as the "apparatus") 10, which provides a means to easily and efficiently attach, remove, and deploy light strings 40 to and from a house or similar structure, particularly holiday lights during a festive season. The apparatus 10 comprises an inverted light track 20 which is fastened thereto a mounting surface 70 and enables a user to deploy said light string 40 therefrom a removably attachable light storage box 30. The apparatus 10 enables a user to quickly deploy and take down light strings 40 in a safe manner and enables different lights for various festive occasions to be used.

Figure 2:
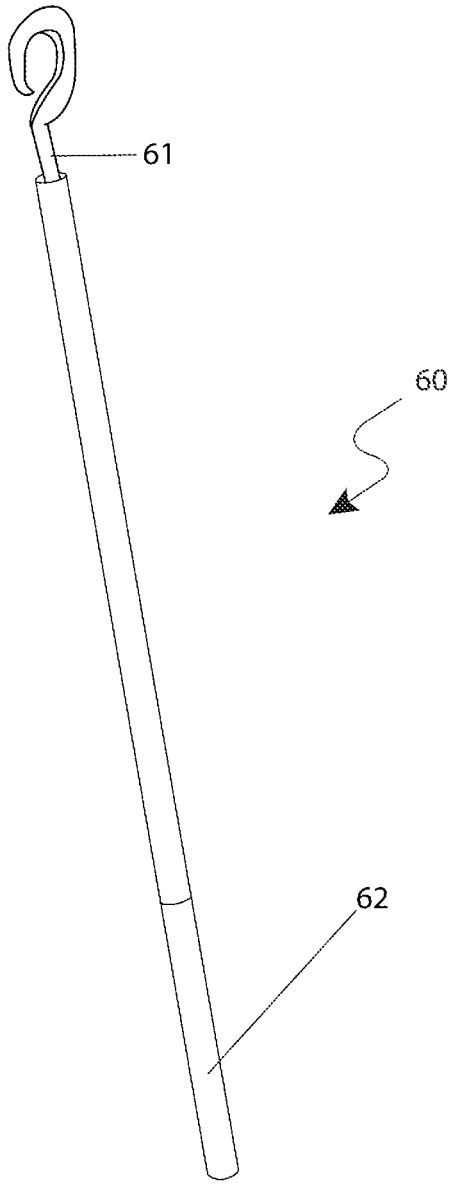
FIG. 2 is a front view of a stick 60, according to a preferred embodiment of the present invention.

Referring now to FIG. 1, a side environmental view of the apparatus 10 and FIG. 2, a front view of the stick 60, according to the preferred embodiment of the present invention, are disclosed. The apparatus 10 comprises a light track 20, a light box 30, a light string 40, and a plurality of hangers 50. The general component piece parts of the apparatus 10 are preferably made of a light weight, durable, weather resistant material such as, but not limited to: aluminum, thermoplastic, or the like and are fabricated via common techniques. The light track 20 comprises an elongated track body and is mounted thereto an underside of a mounting surface 70 such as, but not limited to: a soffit, a gutter, or the like via a plurality of mounting fasteners 23 which are preferably nails, screws, or the like. The light track 20 is made available in up to ten (10) foot long sections which may be joined together in order to form any length desired by a user and capable of being easily cut to any length with standard hand tools in order to fit therein any necessary spot. The light track sections 20 are preferably aligned together via arranging an end of one (1) light track 20 with the end of another light track 20 in a parallel manner and fastening to the mounting surface 70 as above-mentioned, yet other aligning means may be provided without limiting the functions of the apparatus 10.

The light box 30 houses the light string 40 during times of the year when said light string 40 is not being utilized. During periods when light strings 40 are utilized for decorative purposes, the light box 30 is removably attached thereto an end of the light track 20 which enables said light string 40 to be deployed therefrom said light box 30 and thereinto the light track 20 via the hangers 50. The light string 40 comprises expected features similar to other commercially available string, icicle, or curtain lights, such as electrical wiring, a plurality of lights 41, a plurality of bulb receptacles 42, a plug, and the like (see FIG. 3). The light string 30 further comprises a pull ring 44 which is located thereon a distal end. The pull ring 44 enables a user to deploy the light string 40 via engaging said pull ring 44 with a hook 61 thereon the distal end of a cylindrical stick 60 and pulling said light string 40 therearound a house or similar structure therethrough the light track 20. Said stick 60 is detached from the apparatus 10 and enables the user to grasp the pull ring 44 from ground level. The stick 60 comprises a hook 61 and a handle 62. The hook 61 thereon the stick 60 is preferably integrally molded thereto the distal end thereof. The handle 62 is located thereon a proximal end thereof and provides a means for a user to digitally grasp the stick 60. The stick 60 is fabricated from materials such as, but not limited to: wood, aluminum, plastic, or the like.

Figure 3:
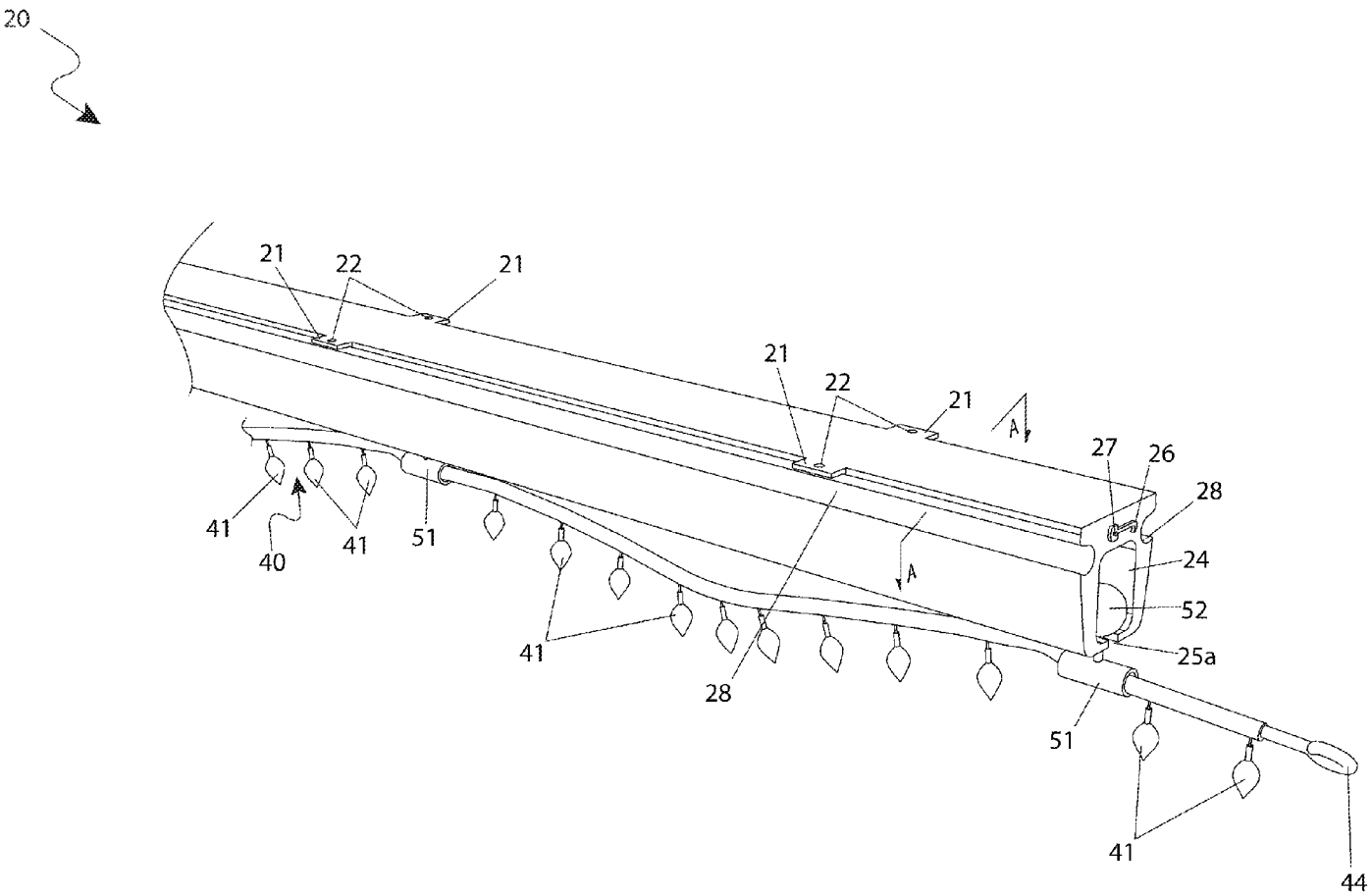
FIG. 3 is a side perspective view of a segment of a light track 20, according to a preferred embodiment of the present invention.
Figure 4:
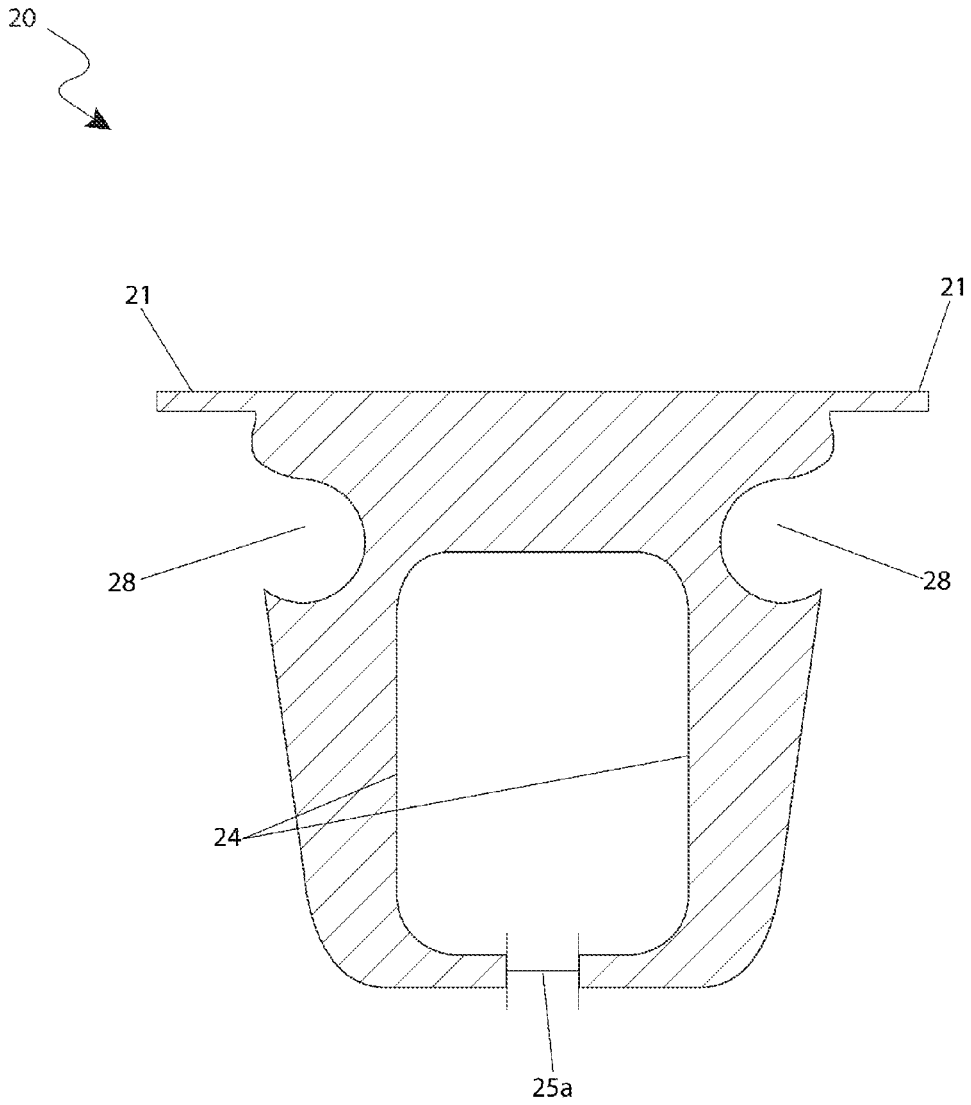
FIG. 4 is a section view of a segment of a light track 20 taken along line A-A FIG. 3, according to a preferred embodiment of the present invention.

Referring now to FIG. 3, a side perspective view of a segment of the light track 20 and FIG. 4, a section view of the light track 20 taken along line A-A FIG. 3, according to the preferred embodiment of the present invention, are disclosed. The light track 20 comprises a plurality of fastener tabs 21 equally spaced thereat opposing sides of a top perimeter surface of said light track 20. Each fastener tab 21 comprises a fastener aperture 22 through which provides a means of attaching the light track thereto the mounting surface 70 via a corresponding fastener 23. The light track 20 is comprised of a rectangular-shaped channel further comprising a hollow inner track 24. The inner track 24 provides a means to house and guide the plurality of hangers 50 which slide therewithin in a similar manner as a shower curtain or the like. The light track 20 further comprises a first hanger slot 25*a* located along a bottom surface of said light track 20 which provides an opening through which the hanger 50 may extend in order to secure the light string 40 thereto the light track 20. The light track 20 further comprises an end hook 26 rotatingly attached thereto a vertical end surface of said light track 20 via a hook fastener 27. The end hook 26 is positioned in a horizontal orientation as illustrated during the assembly of the light track 20 and then to pivot therearound the hook fastener 27 approximately ninety degrees (90°) to a vertical orientation. Once in a vertical orientation, the end hook 26 engages the pull ring 44, thereby providing a means of securing the light string 40 in a taut and immobile position once said light string 40 has been deployed. An opposing end of the light string 40 comprises a standard electrical plug 43 and engages a standard electrical receptacle thereby providing power thereto said light string 40 and securing said plug 43 end. The light track 20 further comprises a recessed groove 28 disposed along the entire length of opposing upper outer surfaces of said light track 20 which interface with corresponding protruding rails 32 therein the light box (see FIG. 4).

Figure 5:
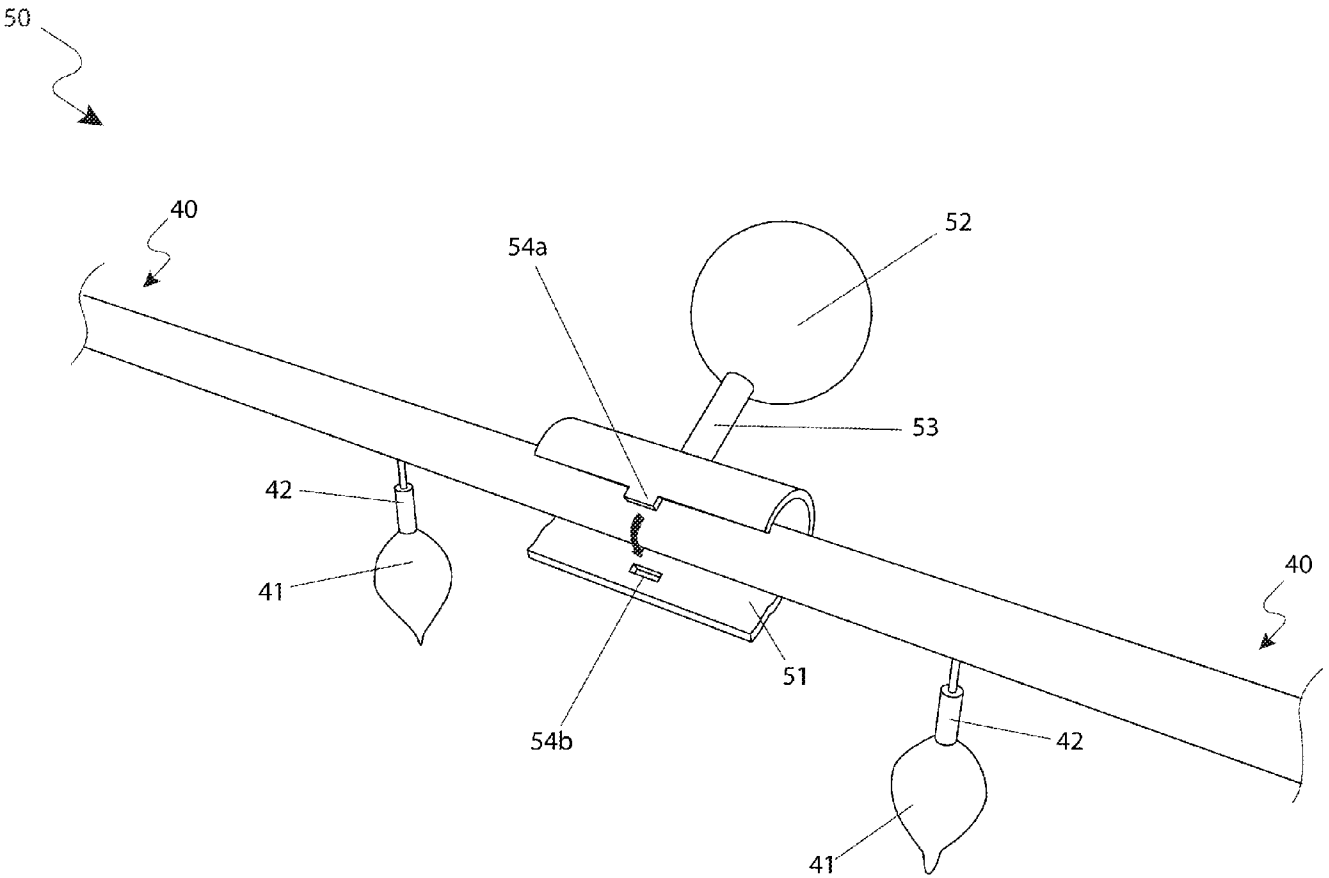
FIG. 5 is a side perspective view of a hanger 50, according to a preferred embodiment of the present invention; and, FIG. 6 is a front perspective view of a light box 30, according to a preferred embodiment of the present invention.

Referring now to FIG. 5, a side perspective view of the hanger 50, according to the preferred embodiment of the present invention, is disclosed. Although illustrated herein as comprising a removably attachable hanger 50, it is known that said hanger 50 may be retrofitted to the light string 40 without limiting the functions of the apparatus 10. The hanger 50 comprises a roller 52, a clip 51, a stem 53, a second fastener 54*a*, and a second slot 54*b*. The roller 52 is a generally round member which fits therewithin and traverses along the inner track 24 of the light track 20 providing three-hundred-sixty degrees (360°) of movement therewithin. The stem 53 extends out therefrom the roller 52 and once the hanger 50 is inserted therein the inner track 24, said stem 53 protrudes therethrough the underneath surface of the light track 20 and traverses therewithin the first hanger slot 25*a*. The clip 51 is located thereon an end of the stem 53 opposing the roller 52 and comprises a tubular clamp-like segment which is capable of being opened in order to accept and secure the light string 40. The second fastener 54*a* is inserted into the second slot 54*b*, thereby securing the clip 51 in a closed position via an interference fit, a snap fit, or the like. The total number of hangers 50 used with the apparatus 10 preferably varies depending on the length of the light track 20 and the length and configuration of the light string 40. The hangers 50 enable the apparatus 10 to remove the light string 40 for repair or replacement if required via the clip 51.

Figure 6:
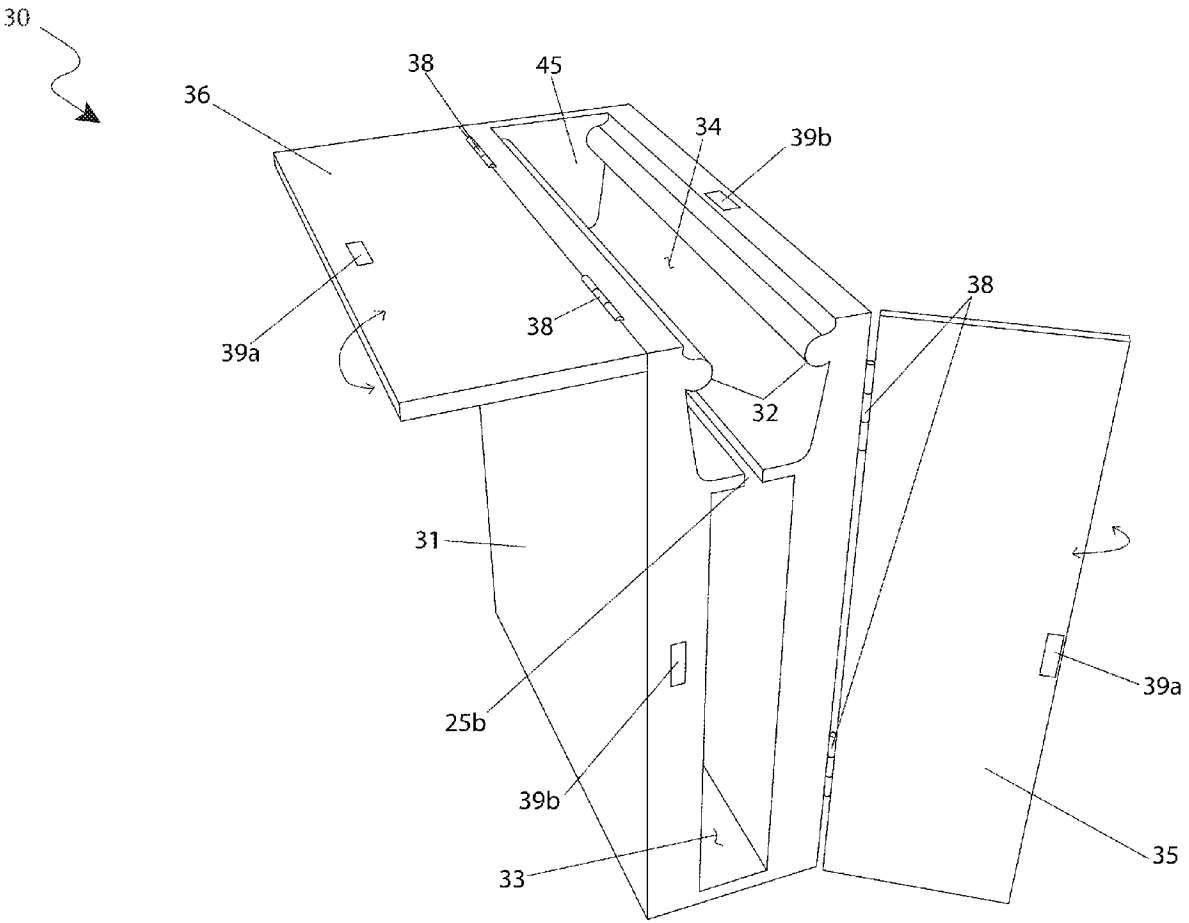

Referring now to FIG. 6, a front perspective view of the light box 30, according to the preferred embodiment of the present invention, is disclosed. The light box 30 generally comprises a main body 31, a pair of rails 32, an open front 33, a rear wall 45, and an open top 34. The body 30 comprises the general shape of a rectangular box. The rails 32 are located on upper inner opposing surfaces of the light box 30 and create interference fit therewith the grooves 28 of the light track 20. The open top 34 portion of the light box 30 comprises a shape which generally corresponds to the outer shape of the light track 20 and acts as a receiving channel section for the end thereof said light track 20 further comprising a second hanger slot 25*b* for permitting passage of the stem portion 53 of each hanger 50. The rear wall 45 provides a limit of maximum insertion of the light track 20 thereinto the open top 34 portion and is an end-stop for the end of said light track 20. The open front 33 portion of the light box 30 houses the light string 40 and allows said light string 40 to be deployed therefrom. The light string 40 neatly loops therewithin the open front 33 portion the similar to an open curtain. The light box 30 provides a storing means for the light string 40 and the plurality of associated hangers 50 when said light string 40 is not being used for decoration. Once the light string 40 and hangers 50 have been housed therewithin the light box 30 a front door 35 and top door 36 may be closed in order to provide an enclosed storage area. The doors 35 and 36 are pivotally attached thereto the light box 30 via conventional hinges 38 and are secured in a closed position thereto said light box 30 via a first fastener 39*a* and a second fastener 39*b*. Each first fastener 39*a* is preferably a conventional permanent magnet, yet other fastening means may be utilized without limiting the functions of the apparatus 10. Each second fastener 39*b* is preferably a ferromagnetic material, yet other materials which are attracted to magnets may be utilized without limiting the functions of the apparatus 10. In use, each first fastener 39*a* engages a respective second fastener 39*b*, thereby positioning the front door 35 and top door 36 in a closed position. Since the light box 30 is removably attached thereto the light track 20, said light track 20 requires a minimum amount of open space beyond an attaching end thereof in order to allow said light box 30 to fit thereon said end of said light track 20.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1 through 6.

The method of aligning the apparatus 10 may be achieved by performing the following steps: acquiring the apparatus 10; cutting segments of the light track 20 to achieve a desired length of light track 20; mounting the light track 20 thereto the mounting surface 70, thereby inserting a plurality of mounting fasteners 23 thereinto corresponding fastener apertures 22 thereon each fastener tab 21; repeating the abovementioned process for a desired amount of light tracks 20; acquiring another pre-cut length of light track 20 and aligning each groove 28 on one (1) light track 20 to each groove 28 thereon the other light track 20 in a parallel manner; mounting the light track 20 thereto the mounting surface 70 via the mounting fasteners 23; and, repeating as desired.

The method of utilizing the apparatus 10 may be achieved by performing the following steps: retrieving the light box 30 which houses the length of light string 40 and hangers 50; opening the front door 35 and the top door 36, thereby disengaging the first fasteners 39*a* from the second fasteners 39*b*; sliding the light box 30 thereon the light track 20 via engaging the rails 32 therewith the grooves 28 wherein the roller portion 52 of each hanger 50 is fully engaged therein the inner track portion 24 of the light track 20; grasping the handle 62 thereon the stick and engaging the pull ring 44 therewith the hook 61; deploying the light string 40 by guiding the hangers 50 from the open top 34 area of the light box 30 thereto the inner track 24 portion of the light track 20; continuing to pull the light string 40 therefrom the light box 30 until said entire light string 40 is fully deployed; rotating the end hook 26 to a vertical orientation; engaging the end hook 26 therewith the pull ring 44 to secure the light string 40 to the light track 20; removing the light box 30 therefrom the light track 20; inserting the plug 43 thereinto a standard electrical receptacle or extension cord; and, supplying power to the lights 41.

The method of removing the apparatus 10 may be achieved by performing the following steps: removing the light string 40 when desired; disengaging the end hook 26 therefrom the pull ring 43; attaching the light box 30 thereto the light track 20; grasping the handle 62 thereon the stick 60 and engaging the pull ring 44 therewith the hook 61; pulling the light string 40 toward the light box 30, thereby pushing the hangers 50 back therethrough the inner track 24 and thereinto the light box 30; continuing pulling the pull ring 44 until the entire light string 40 and all hangers 50 are within the light box 30; removing the light box 30 therefrom the light track 20; closing the doors 35, 36 via engaging the first fasteners 39*a* to the second fasteners 39*b*; storing the light box 30 until another desired time; and, benefiting from the improved convenience and increased safety afforded a user of the present apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A lighting fixture and means for deploying said lighting fixture, comprising:

at least one section of a track;

a mounting means for mounting said track thereto a support structure;

a plurality of hangers movably attached to said track;

a light string suspended from said plurality of hangers, further comprising a plurality of illuminating devices in electrical communication therewith a power source;

a light box removably attached to said track, comprising:

a body, comprising a pair of opposing side walls, a bottom wall, and a rear wall;

a top door hingedly attached to an upper surface of one side wall and said rear wall, further comprising a top door latching feature on an upper surface of an opposing side wall;

a front door hingedly attached to a front surface of one side wall and said bottom wall, further comprising a front door latching feature on a front surface of an opposing side wall;

a pair of rails located on upper inner opposing surfaces of said light box and terminating at said rear wall;

an open top portion for receiving said plurality of hangers, further comprising a bottom surface;

a second hanger slot located and extending along an entire length of said bottom surface of said open top portion to provide an opening through which said plurality of hangers extend; and, an open front portion subjacent to said open top portion for receiving said light string;

wherein each section of track further comprises:

an elongated body comprising an upper surface, a pair of opposing side walls, a pair of opposing end walls, and a bottom surface;

a pair of grooves located on said opposing side walls of said elongated body;

an inner track to house and guide said plurality of hangers, extending an entire length of said body; and, a first hanger slot located and extending along an entire length of said bottom surface to provide an opening through which said plurality of hangers extend;

wherein said light string is manipulated between a deployed state and said stored state by moving said plurality of hangers respective to said track;

wherein said light box provides a means to store said plurality of hangers and said light string when in said stored state;

wherein said pair of rails engage said pair of grooves of said track to slidably attach said light box to said track;

wherein said rear wall provides a stop for said track;

wherein said open top portion of said light box comprises dimensions corresponding to said inner track of said track;

wherein said top door provides access to and a securing means for said open top portion; and, wherein said front door provides access to and a securing means for said open front portion.

2. The lighting fixture and means for deploying said lighting fixture of claim 1, wherein said adjacent tracks are mounted so as to abut one another in an end-to-end configuration.

3. The lighting fixture and means for deploying said lighting fixture of claim 1, wherein said mounting means comprises:

a plurality of fastener tabs each comprising a fastener aperture spaced at equidistant locations at opposing sides of said upper surface; and, a fastener routed through said fastener aperture to fasten said track thereto said support structure.

4. The lighting fixture and means for deploying said lighting fixture of claim 3, wherein said track is mounted thereto a horizontal exterior location.

5. The lighting fixture and means for deploying said lighting fixture of claim 1, wherein said plurality of hangers each further comprises:

a roller member slidably engaging said inner track;

a stem having an upper end extending outwardly from said roller member and protruding downwardly through said first hanger slot; and, a clip located thereon a bottom end of said stem removably attachable to said light string and secured with a clip securing means.

6. The lighting fixture and means for deploying said lighting fixture of claim 1, wherein said light string further comprises:

an electrical connector at a proximal end; and, a pull ring located thereon a distal end;

wherein said pull ring enables manipulation of said light string, wherein said plurality of hangers are deployed therein said track.

7. The lighting fixture and means for deploying said lighting fixture of claim 6, wherein said track further comprises an end hook pivotally affixed to at least one of said pair of opposing end walls above said inner track for engaging said pull ring, thereby providing a light string securing means.

8. The lighting fixture and means for deployment of claim 6, wherein additional light strings are electrically connected thereto each other.

9. The lighting fixture and means for deploying said lighting fixture of claim 6, further comprising an elongated stick, further comprising a handle on a proximal end and a hook on a distal end;

wherein said hook engages said pull ring for deploying said light string and said plurality of hangers along said track.

10. A lighting fixture and means for deploying said lighting fixture, comprising:

at least one section of a track, further comprising:

an elongated body having an upper surface, a pair of opposing side walls, a pair of opposing end walls, and a bottom surface;

a pair of grooves located on said opposing side walls of said elongated body;

an inner track extending an entire length of said body; and, a first hanger slot located and extending along an entire length of said bottom surface;

a mounting means for mounting said track thereto a support structure;

a light string comprising and electrical cord, further comprising:

a pull ring located thereon a distal end;

an electrical connector located at a proximal end; and, a plurality of illuminating devices spaced along said electrical cord in electrical communication therewith a power source;

wherein said pull ring enables manipulation of said light string, wherein said plurality of hangers are deployed therein said track;

a plurality of hangers movably attached to said track, each further comprising:

a roller member slidably engaging said inner track;

a stem having an upper end extending outwardly from said roller member; and, a clip located thereon a bottom end of said stem removably attachable to said light string and secured with a clip securing means;

a light box removably attached to said track, further comprising:

a body, comprising a pair of opposing side walls, a bottom wall, and a rear wall providing a stop for said track;

a pair of rails located on upper inner opposing surfaces of the light box and terminating at said rear wall for slidably engaging said pair of grooves;

an open top portion comprising dimensions corresponding to said inner track for receiving said plurality of hangers, further comprising a bottom surface;

a second hanger slot located and extending along an entire length of said bottom surface of said open top portion;

an open front portion subjacent to said open top portion for receiving said light string when in said stored state;

a top door hingedly attached to an upper surface of one side wall and said rear wall to provide access to and a securing means for said open top portion, further comprising a top door latching feature on an upper surface of an opposing side wall; and, a front door hingedly attached to a front surface of one side wall and said bottom wall, further comprising a front door latching feature on a front surface of an opposing side wall to provide access to and a securing means for said open front portion; and, an elongated stick, further comprising a handle on a proximal end and a hook on a distal end;

wherein said light string is manipulated between a deployed state and said stored state by moving said plurality of hangers respective to said track;

wherein said stem protrudes downwardly through said first hanger slot during said deployed state;

wherein said stem protrudes downwardly through said second hanger slot during said stored state; and, wherein said hook engages said pull ring for deploying said light string and said plurality of hangers along said track between said deployed state and said stored state.

11. The lighting fixture and means for deploying said lighting fixture of claim 10, wherein said adjacent tracks are mounted so as to abut one another in an end-to-end configuration.

12. The lighting fixture and means for deploying said lighting fixture of claim 10, wherein said mounting means comprises:

a plurality of fastener tabs each comprising a fastener aperture spaced at equidistant locations at opposing sides of said upper surface; and, a fastener routed through said fastener aperture to fasten said track thereto said support structure.

13. The lighting fixture and means for deploying said lighting fixture of claim 10, wherein said track is mounted thereto a horizontal exterior location.

14. The lighting fixture and means for deploying said lighting fixture of claim 10, wherein said track further comprises an end hook pivotally affixed to at least one of said pair of opposing end walls above said inner track for engaging said pull ring, thereby providing a light string securing means.

15. The lighting fixture and means for deployment of claim 10, wherein additional light strings are electrically connected thereto each other.

16. A method for mounting a lighting fixture and deploying said light fixture from a stored state within a light box to a deployed state comprises the following steps:

providing an elongated track, comprising:

an elongated body having an upper surface, a pair of opposing side walls, a pair of opposing end walls, and a bottom surface;

a plurality of fastener tabs each comprising a fastener aperture spaced at equidistant locations at opposing sides of said upper surface;

a pair of grooves located on said opposing side walls of said elongated body; an inner track extending an entire length of said body;

a first hanger slot located and extending along an entire length of said bottom surface to provide an opening through which said plurality of hangers extend; and, an end hook pivotally affixed to at least one of said pair of opposing end walls above said inner track;

mounting said track to a horizontal surface therewith a plurality of fasteners through said fastener aperture of each of said plurality of fastener tabs, ensuring that enough space is provided to install a light box comprising at least one light string suspended from a plurality of hangers;

providing said light box, further comprising:

a body, comprising a pair of opposing side walls, a bottom wall, and a rear wall providing a stop for said track;

a pair of rails located on upper inner opposing surfaces of the light box and terminating at said rear wall;

an open top portion comprising dimensions corresponding to said inner track, further comprising a bottom surface;

a second hanger slot located and extending along an entire length of said bottom surface of said open top portion;

an open front portion subjacent to said open top portion;

a top door hingedly attached to an upper surface of one side wall and said rear wall, further comprising a top door latching feature on an upper surface of an opposing side wall; and, a front door hingedly attached to a front surface of one side wall and said bottom wall, further comprising a front door latching feature on a front surface of an opposing side wall;

slidably engaging said light box onto said track by engaging said pair of rails in said pair of grooves until abutting against said rear wall, ensuring that a roller member of each of said plurality of hangers is slidably inserted into said inner track;

opening said front door, thereby providing access thereto said open front portion where said light string resides, said light string suspended from and removably attached to a clip portion of said roller member of each of said plurality of hangers, said light string having an electrical connector at a proximal end, a pull ring at a distal end, and a plurality of illuminating devices;

providing an elongated stick with a hook at a distal end;

deploying said light string by engaging said hook into said pull ring and advancing said roller members of each of said plurality of hangers down a length of said track, thereby carrying said light string, such that each of said plurality of hangers are fully deployed from said light box;

securing said light string to said track by engaging said pull ring with said end hook;

removing said light box from said track; and, supplying power to said light string to illuminate said light string.

17. The method of claim 16, further comprising the step of:

abutting a plurality of tracks thereto each other to achieve a desired length, wherein an inner track of a first track is aligned with an inner track of an adjacent track; and, deploying said light string along said desired length.

* * * * *